United States Patent [19]

van der Toorn

[11] Patent Number: 5,038,926

[45] Date of Patent: Aug. 13, 1991

[54] DEVICE FOR KEEPING CARDS

[75] Inventor: Aart van der Toorn, Noordwijk, Netherlands

[73] Assignee: Acodeq Trading Company B.V., Netherlands

[21] Appl. No.: 428,157

[22] Filed: Oct. 27, 1989

[30] Foreign Application Priority Data

Nov. 2, 1988 [NL] Netherlands ..... 8802679

[51] Int. Cl.[5] ..... A45C 11/18

[52] U.S. Cl. ..... 206/39.3; 206/39; 206/38; 206/449; 150/147; 150/149; 40/642; 40/156

[58] Field of Search ..... 206/38, 39, 39.3, 39.5, 206/39.7, 232, 453, 455, 449; 40/152, 156, 158.1, 159, 159.2, 642, 649; 150/147, 149

[56] References Cited

U.S. PATENT DOCUMENTS

| | | | |
|---|---|---|---|
| 2,297,285 | 9/1942 | Bledsoe | 40/661 |
| 2,796,667 | 6/1957 | Baker | 40/642 |
| 3,069,795 | 12/1962 | Lieberman | 40/152 |
| 3,203,127 | 8/1965 | Pettersson | 40/152 |
| 3,216,136 | 12/1963 | Lang | 40/10 |
| 3,242,604 | 3/1966 | Ott | 40/152 |
| 3,242,605 | 3/1966 | Kleinschmidt | 40/152 |
| 3,242,959 | 3/1966 | Glass | 150/147 |
| 3,284,939 | 11/1966 | Derrot | 40/152 |
| 3,421,658 | 1/1969 | Cooksey | 206/39.5 |
| 3,490,840 | 1/1970 | Eagle | 40/152 |
| 3,648,832 | 3/1972 | Kirshenbaum et al. | 206/39 |
| 4,141,400 | 2/1979 | Mangan | 150/147 |
| 4,146,985 | 4/1979 | Margulies | 40/159.2 |
| 4,165,890 | 8/1979 | Leff | 40/642 |
| 4,314,417 | 2/1982 | Cain | 40/642 |
| 4,333,253 | 6/1982 | Cooper | 40/642 |
| 4,450,955 | 5/1984 | Featherston | 150/147 |
| 4,477,991 | 10/1984 | Drevitch et al. | 40/152 |
| 4,518,080 | 5/1985 | Ohlson | 206/39 |
| 4,697,698 | 10/1987 | Holdener | 206/39.4 |
| 4,829,691 | 5/1989 | Manjos et al. | 40/661 |

FOREIGN PATENT DOCUMENTS

| | | |
|---|---|---|
| 8709998 | 9/1987 | Fed. Rep. of Germany . |
| 1190943 | 1/1958 | France . |
| 1257460 | 5/1960 | France . |

*Primary Examiner*—David T. Fidei

*Attorney, Agent, or Firm*—Skjerven, Morrill, MacPherson, Franklin & Friel

[57] ABSTRACT

The invention relates to a device for keeping cards, said device being provided with at least one card holder in which a card can be held at at least some of its edges, while the card holder is rotatably connected with lids located above and under the card holder. The card holder is provided with four legs bounding a rectangular through opening the size of a card to be accommodated, the legs forming a closed frame with external dimensions at least substantially equal to the external dimensions of a lid. The legs are provided with parts projecting into the opening, such that a card inserted into the opening is enclosed between at least one pair of projecting parts forming part of two opposed legs, said parts butting against the upper surface of the card, and at least one pair of projecting parts, which also form part of two opposed legs and which butt against the lower surface of the card.

10 Claims, 6 Drawing Sheets

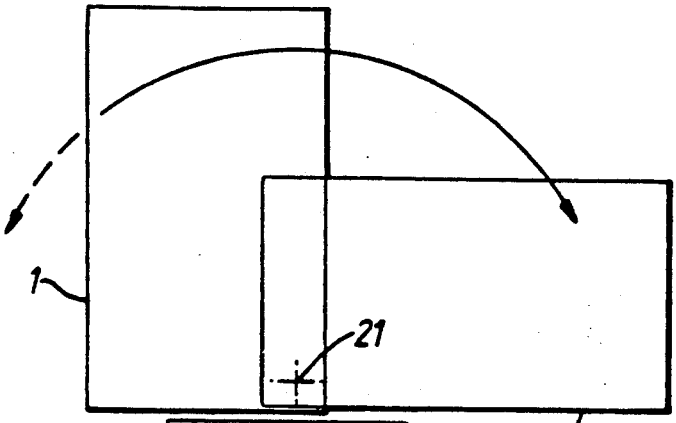
FIG 20-A
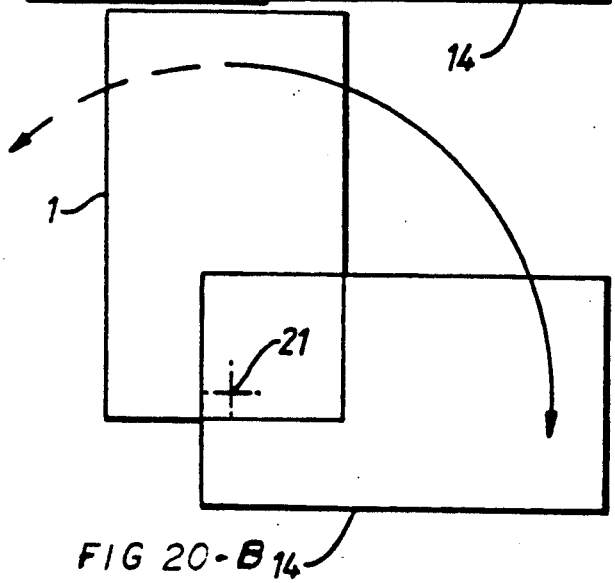
FIG 20-B
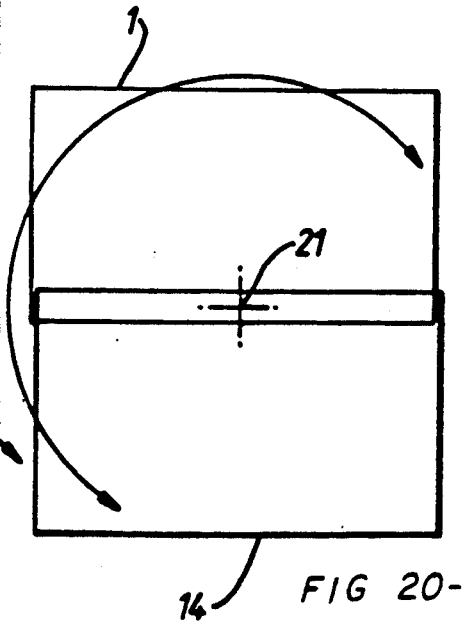
FIG 20-C
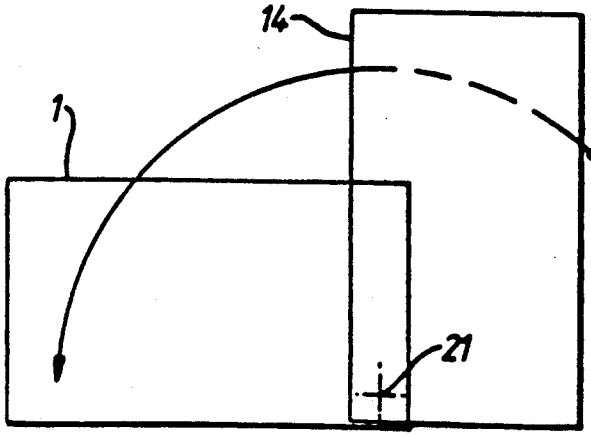
FIG. 20.- D

DEVICE FOR KEEPING CARDS

BACKGROUND OF THE INVENTION

1. Field of the Invention

The invention relates to a device for keeping cards, said device being provided with at least one card holder in which a card can be held at at least some of its edges, whilst the card holder is rotatably connected with lids located above and under the card holder.

2. Related Art

The use of so-called credit-cards and bank cards, as well as membership cards, visiting cards and identity cards, whose size corresponds with the usual size of credit cards or bank cards, is increasing steadily. This presents the users of these cards with the problem of keeping said cards to be carried about. Of course it is desirable thereby that the cards are easy to find and to show, whilst at the same time the cards must be suitably protected against damage. The latter is especially true of cards which are provided with magnetic strips and/or other data carriers, such as chips. Because of this some distributers of cards have proceeded to hand out a pocket-shaped, hard plastic card holder for every card they issue. Such a holder is only suitable for accommodating a single card, however, and is rather voluminous in relation to the dimensions of the card itself. In practice the users cannot be expected to carry about a number of such holders, each containing a different card, therefore.

From U.S. Pat. No. 3,648,832 there is known a device for keeping cards of the above kind, wherein each card holder is formed by a U-shaped means whose two legs and the connecting piece connecting the legs have a U-shaped section for accommodating edges of the cards. The legs are resilient thereby, such that they are pressed apart when a card is moved between the legs, in order to be able to hold the card with a certain clamping force. There is a danger hereby that the card will be slightly bent under the influence of the clamping force of the legs, and will come into contact with a neighbouring card in the closed position of the device, which may lead to damage to the cards.

A further disadvantage of said known device is that the dimensions of the two lids must be such that in the closed position of the device the card holders are completely enclosed within the lids in order to keep the cards from moving out of the U-shaped card holders. This leads to a rather volumimous construction of said known device.

It is noted that from FR-A-1,190,943 there is known a device for accommodating cards whereby a separate pocket-shaped card holder is provided for each card. The pockets are thereby formed of two thin foils, which are attached together along three edges, whilst a fourth narrow edge is open for the card to be put in or taken out of the pocket in question. Putting the card in such a pocket-shaped holder is difficult and time-consuming, since, certainly after some use, the foils will tend to stick together. Furthermore the foils forming the walls of the pocket-shaped holders will easily become soiled and/or damaged.

From the French patent specification 1,257,460 (FIG. 4) there is known a holder for a label, said holder being provided with a more or less trapezoidal recess which is bounded by a circular edge, whose side directed towards the recess has a V-shaped section. Such a construction is not suitable for regularly putting in and taking out cards. From said publication no indication can be derived with regard to a solution for keeping credit cards and the like, therefore.

From U.S. Pat. No. 3,216,136 there is furthermore known a frame-shaped holder, to be secured to a chain, said holder being provided with lips which project into the opening bounded by the frame-shaped holder, for holding a plate made of plastic material in the opening, such that said plate can only be removed from the holder by means of a knife-shaped blade. The plate of plastic material is thereby intended for accommodating test data relating to the chain to which the holder is secured. Said known holder is not suitable and/or intended for combinations with other holders and lids for forming a device for keeping credit cards or the like.

SUMMARY OF THE INVENTION

According to the invention the card holder is provided with four legs bounding a rectangular through opening the size of a card to be accommodated, said legs forming a closed frame with external dimensions at least substantially equal to the external dimensions of a lid, whereby the legs are provided with parts projecting into the opening, such that a card inserted into the opening is enclosed between at least one pair of projecting parts forming part of two opposed legs, said parts butting against the upper surface of the card, and at least one pair of projecting parts, which also form part of two opposed legs and which butt against the lower surface of the card.

When using the construction according to the invention a card, when being inserted into a card holder, can be simply clicked between the projecting parts and thus be accommodated in a card holder, without forces being exerted on the card once the card has been inserted into the card holder, which forces may cause deformation and/or damage to the card. Furthermore it is not necessary, because of the closed frame-shaped configuration of the card holders, for the lids to surround the card holders, so that the external dimensions of the card holders and the lids can be at least substantially equal to one another, which leads to a compact construction of the device.

When using the construction according to the invention one or more frame-shaped means, each containing one card, may be provided between the lids. In the closed position of the device the card or the cards will be covered at their upper and lower sides by the lids, and by the frame-shaped means at their sides. In order to show the desired card it is only necessary to pivot the lids and the frame-shaped means relative to one another in the manner of a fan, as a result of which the desired card can be quickly and simply found, the card can also be shown well-visibly and be easily removed.

The device can be easily adapted to the individual user, since each desired number of frame-shaped means can be accommodated between the lids. As the frame-shaped means are normally enclosed by the lids said frame-shaped means are well-protected, too, and can be made relatively thin, so that when using the construction according to the invention several cards can be effectively and efficiently kept in a device having a compact construction.

The invention will be further explained hereafter with reference to a few embodiments of the device according to the invention illustrated in the accompanying figures.

BRIEF DESCRIPTION OF THE DRAWING

FIG. 20-A diagrammatically illustrates a corner pivot pin location for pivoting a lid and card holder.

FIG. 20-B diagrammatically illustrates a central end pivot pin location for pivoting a lid and card holder.

FIG. 20-C diagrammatically illustrates a longitudinal central edge pin location for pivoting a lid and card holder.

FIG. 20-D diagrammatically illustrates a corner pivot pin opposite that of FIG. 20-A for pivoting a lid and card holder.

DETAILED DESCRIPTION

Figure 1:
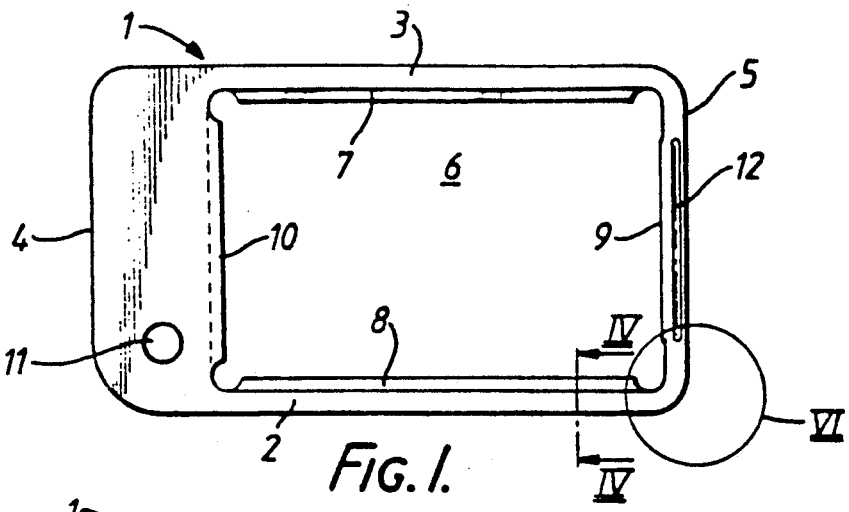
FIG. 1 is a plan view of a first embodiment of a card holder according to the invention.

The frame-shaped means or card holder 1 illustrated in FIG. 1 comprises a pair of long sides or legs 2 and 3, whose ends are interconnected by a short side or leg 4 having a comparatively large width and a further short side or leg 5, which has at least substantially the same width as the long sides 2 and 3. The sides or legs 2–5 of the card holder enclose an opening 6.

Figure 4:
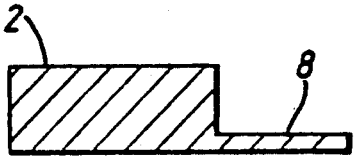
FIG. 4 is a larger-scale section of FIG. 1 and FIG. 6, respectively, along the line IV—IV.
Figure 6:
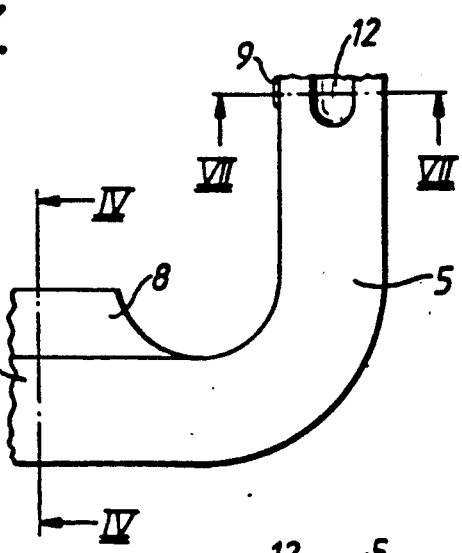
FIG. 6 is a larger-scale illustration of the detail VI encircled in FIG. 1.
Figure 5:
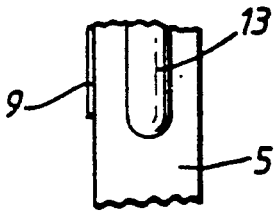
FIG. 5 is a larger-scale illustration of the detail V encircled in FIG. 3.

Projecting parts or ribs 7 and 8, extending towards one another, join the facing edges of the long sides 2 and 3. As appears in particular from FIG. 4 such a rib 7 or 8 thereby has a thickness which is considerably less than the thickness of the long side 2 or 3 in question; in the illustrated embodiment the thickness of the rib 8 is about one fifth of the thickness of the long side 3. The ribs 7 and 8 furthermore join the bottom sides of the long sides 2 and 3, seen in FIGS. 1 and 4.

Similar projecting parts or ribs 9 and 10 join the facing edges of the short sides 4 and 5. Said ribs 9 and 10 thereby join the upper sides of the relevant ribs 4 and 5, however, as is also apparent from FIG. 7. The width of the rib 9 has thereby been selected smaller than the width of the rib 10.

The construction is now such that a credit-card or similar card having the dimensions of a credit-card can be put on the ribs 7 and 8, seen in FIG. 1, and be moved under the rib 10. Then the end of the credit-card located near the rib 9 can be clicked under the rib 9 by deforming the frame and/or the credit-card or the like, so that the credit-card will then be enclosed between ribs 7 and 8 extending under the credit-card, and the ribs 9 and 10 extending above the credit-card. The credit-card lies well-enclosed in the frame 1 thereby, whilst the credit-card is very well visible on both sides. On the other hand the credit-card can be easily removed again, by pressing the end of the credit-card located near the rib 9 along the rib 9, after which the credit-card can be moved out of the frame.

In an embodiment that has appeared to be effective the thickness of the sides 2–5 has been selected at ±1.4–1.6 mm, whilst the thickness of the ribs 7–10 has been selected at ±0.3–0.5 mm. In this embodiment the credit-card will lie well-enclosed within the frame, without projecting from the upper or lower side of the frame; in fact the sides of the frame project slightly from the upper and the lower side of the card.

As is furthermore illustrated in the FIGS. a hole 11 is provided in the short wide side 4, the central axis of said hole extending perpendicularly to the frame 1. The purpose of said hole will be further explained hereafter.

In said embodiment there is furthermore provided, in the upper side of the short side 5, an elongated slot 12 having a semi-circular section, whilst at the lower side of the short side 5 there is formed an elongated projecting rib or nose 13 which is complementary to the slot 12. The purpose of said slot and said nose will be further explained hereafter, too.

The FIGS. 8–13 illustrate an embodiment of a lid intended for use in combination with one or more specimens or the frame described above.

As appears from the FIGS. 8–13 the lid 14 is substantially built up of a flat, closed plate-shaped part 15, which is provided with a thickened circular edge 16, which is wider along one of the short sides than along the other side of the lid.

In the embodiment illustrated in the Figures a slot 17, corresponding with the above-mentioned slot, is provided in the wider side. Instead of said slot there may also be provided a rib or nose 18, indicated by a dotted line and corresponding with the rib or nose 13.

In the lid, near one of the corner points of the lid there is furthermore provided a hole 20 surrounded by a thickened part 19 of the plate-shaped part 15.

Figure 8:
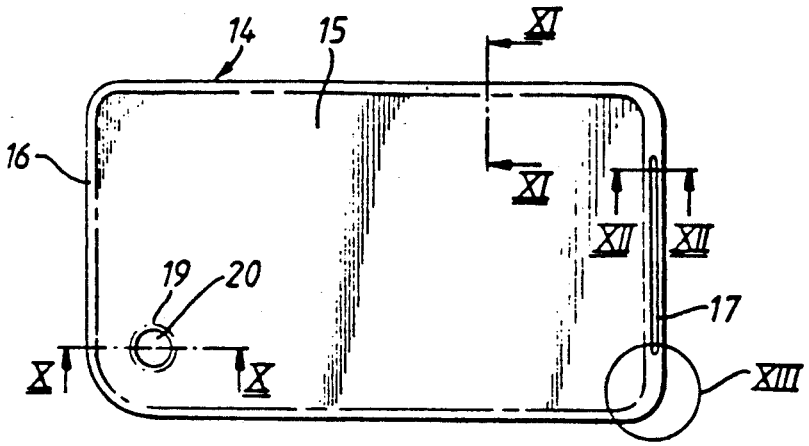
FIG. 8 is a view of a lid of the device according to the invention.
Figure 9:
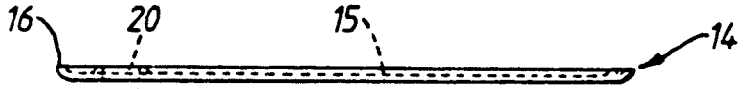
FIG. 9 is a side view of FIG. 8.
Figure 10:
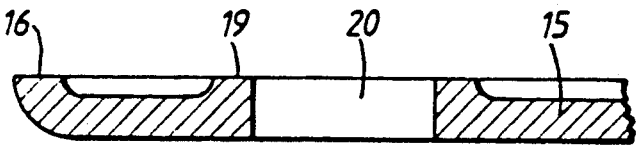
FIG. 10 is a larger-scale section of FIG. 8, along the line X—X in FIG. 8.
Figure 11:
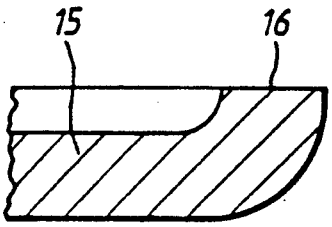
FIG. 11 is a larger-scale section of FIG. 8, along the line XI—XI.
Figure 12:
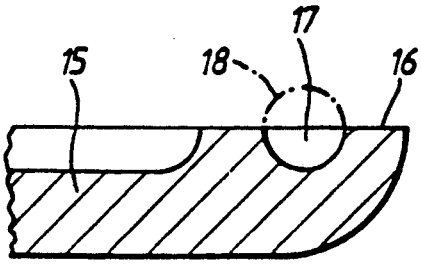
FIG. 12 is a larger-scale section of FIG. 8, along the line XII—XII.
Figure 13:
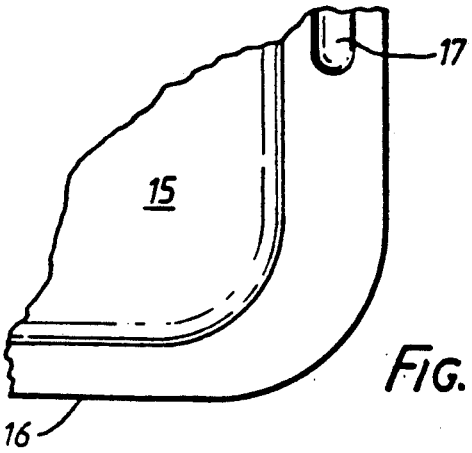
FIG. 13 is a larger-scale illustration of the detail XIII encircled in FIG. 8.
Figure 14:
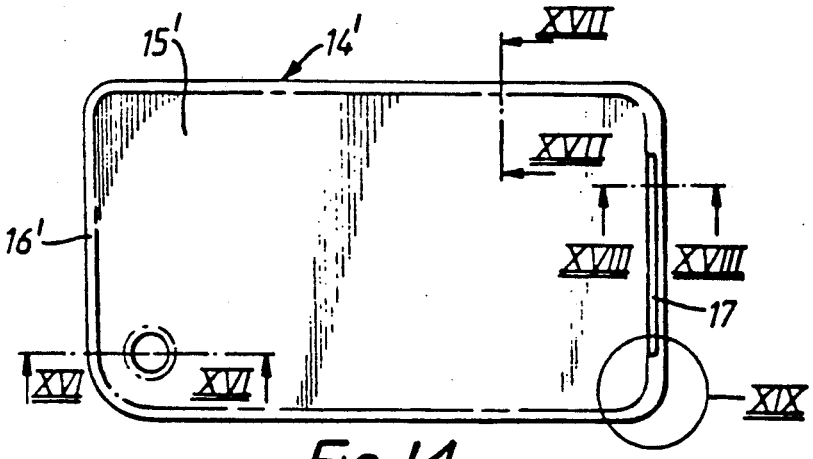
FIG. 14 is a view of a second embodiment of a lid for the device according to the invention.
Figure 15:
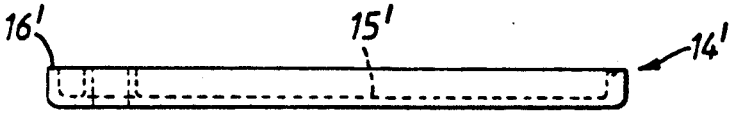
FIG. 15 is a side view of FIG. 14.
Figure 16:
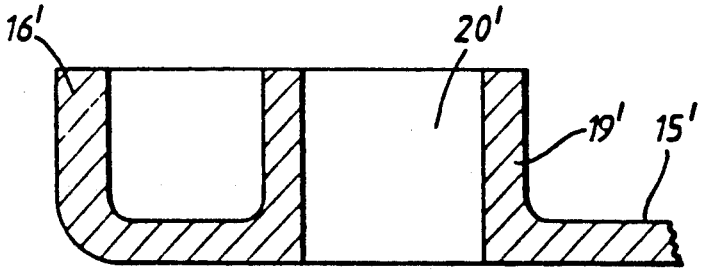
FIG. 16 is a larger-scale section of FIG. 14, along the line XVI—XVI in FIG. 14.
Figure 17:
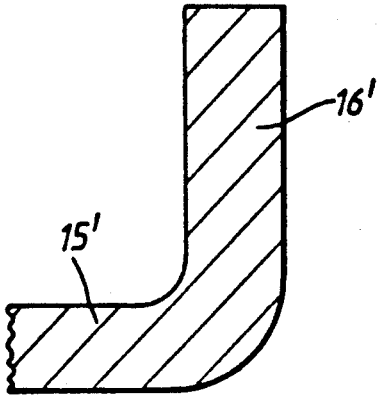
FIG. 17 is a larger-scale section of FIG. 14, along the line XVII—XVII in FIG. 14.
Figure 18:
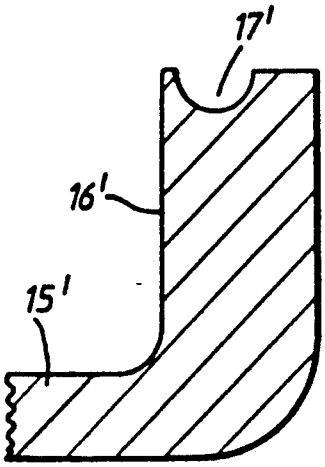
FIG. 18 is a larger-scale section of FIG. 14, along the line XVIII—XVIII in FIG. 14.
Figure 19:
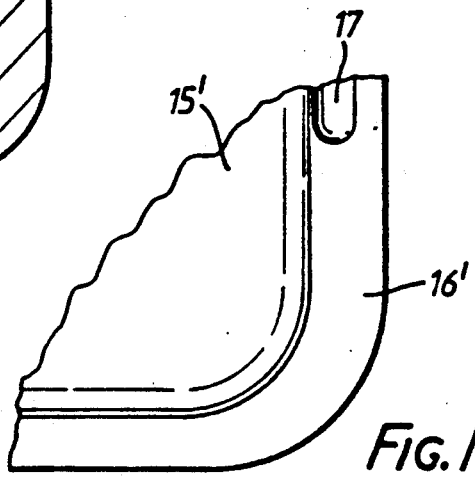
FIG. 19 is a larger-scale illustration of the detail XIX encircled in FIG. 14.

One or more of the frames illustrated in FIG. 1 may be put on the lid illustrated in FIG. 8, such that the bores 11 provided in the frames 1 will come to lie in the extension of the bore 20 in the lid. A lid corresponding with the lid according to FIG. 8, but being the mirror image thereof, can be put on the uppermost frame, so that the frame(s) will be enclosed between the two lids. The two lids and the frame(s) can then be pivotally connected by means of a pivot pin to be passed through the holes 11 and 20.

It will be apparent that as a result of such a pivoting connection of the lids and the frame(s) the parts of the device thus formed by said lids and the frame(s) can be pivoted relative to each other, in order to make visible one or more of the credit-cards or the like accommodated in the frames, after which said card can be easily removed and put back again in a relevant frame, if desired. In the position in which the lids and the cards are located directly above one another, a good protection of the cards kept in the various frames is ensured.

In the "closed" position of the device, in which the lids and the frames will be located directly above one another, a projection 13 or 18, forming part of a lid or a frame, will be located in a corresponding slot 12 or 17 in a neighbouring frame or lid, so that a detachable interlocking between the various parts has been effected.

When the frames and/or the lids are pivoted relative to one another, the projecting ribs or noses 13 or 18 will move over the opposite side of a neighbouring frame or lid, so that when said parts pivot relative to one another said parts are pressed apart somewhat, as it were, as a result of which it is effectively prevented that during the pivoting movement of said parts a card accommodated in a frame moves along a neighbouring part, so that damage to the card will thus be prevented to a large degree.

The FIGS. 14–19 illustrate a further embodiment of a lid. Said lid substantially corresponds with the lid illustrated in the FIGS. 8–13, and corresponding parts have been given corresponding reference numerals, with the addition of an accent-mark.

As a comparison of the Figures will show, the difference between these two embodiments is substantially made up by the difference in the height of the upright edges 16 and 16' resp.

The upright edge 16' of the embodiment according to the FIGS. 14–19 is considerably larger than the edge 16 of the embodiment according to the FIGS. 8–13. As a result of this the possibility has been created to accommodate further objects in the lid according to the embodiment of the FIGS. 14–19, such as e.g. a mirror, a pocket calculator or the like.

The device according to the invention can be constructed with two lids according to the FIGS. 8–13 with one or more frames enclosed therebetween, with two lids according to the FIGS. 14–19 with one or more frame enclosed therebetween, or with one lid according to the FIGS. 8–13 and one lid according to the FIGS. 14–19.

Thus many variations to the embodiment described above are conceivable within the spirit and scope of the invention.

As appears e.g. from FIGS. 20 A–D and FIGS. 36–37 and the the pivot pin 21 formed by the coinciding central axes of the openings 11 and 20, about which the frames 1 and the lids 14 are pivotable relative to one another, may be provided in a left-hand or a right-hand corner point of a short side, in the centre of a short side or in the centre of a long side.

Also for the embodiment of a frame for accommodating a credit-card or the like many possibilities are conceivable, as will be further explained hereafter.

Figure 21:
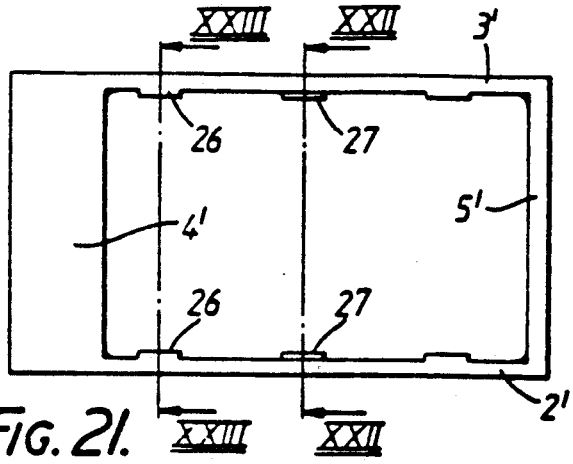
FIG. 21 is a plan view of a second embodiment of a card holder according to the invention.
Figure 22:
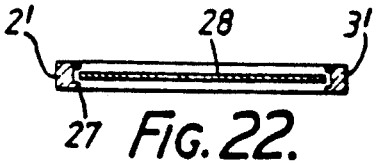
FIG. 22 is a section of FIG. 21, along the line XXII—XXII in FIG. 21.
Figure 23:
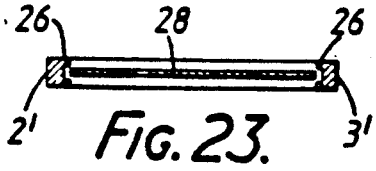
FIG. 23 is a section of FIG. 21, along the line XXIII—XXIII in FIG. 21.

The embodiment illustrated in the FIGS. 21–23 substantially corresponds with the embodiment according to FIG. 1, and corresponding parts have therefore been given corresponding reference numerals, with the addition of an accent-mark.

As will be apparent from these FIGS. 21–23, the projecting parts or ribs 7 and 8, which extend along substantially the entire length of the legs or sides 2 and 3 in the embodiment according to FIG. 1, are replaced by short noses 26 and 27, respectively, extending alternately at the upper side and at the lower side of said ribs, respectively, between which noses there may be enclosed a credit-card 28 in the manner illustrated in the FIGS. 22 and 23.

In a manner similar to the one described above for the embodiment according to the FIGS. 1–6, it will of course be possible for a hole, corresponding with the hole 11, to be provided e.g. in the wide shorter side 4', for the passage of a pin. This also applies to the embodiments illustrated in the FIGS. 24–35, to be further described hereafter.

Figure 2:
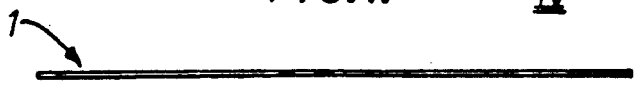
FIG. 2 is a side view of FIG. 1.
Figure 3:
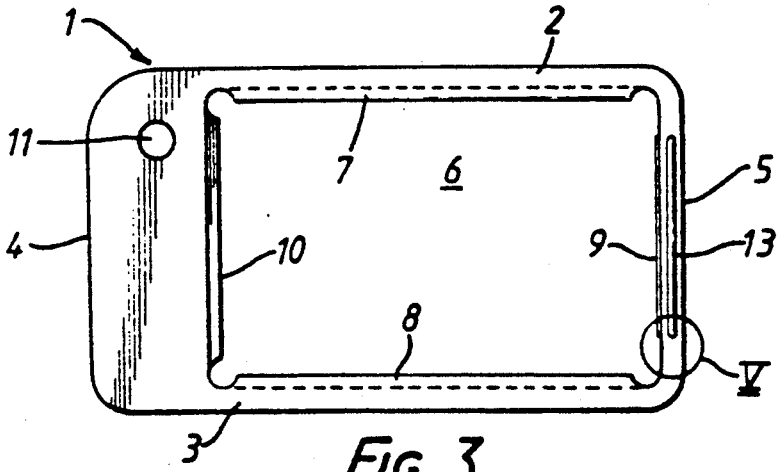
FIG. 3 is a bottom view of FIG. 1.
Figure 24:
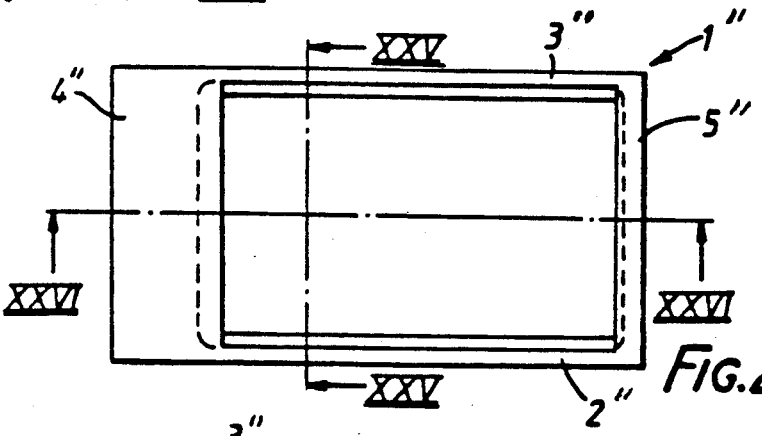
FIG. 24 shows a third embodiment of a card holder according to the invention.
Figure 25:
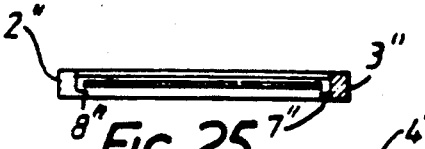
FIG. 25 is a section of FIG. 24, along the line XXV—XXV in FIG. 24.
Figure 26:
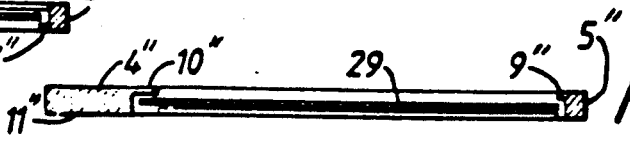
FIG. 26 is a section of FIG. 24, along the line XXVI—XXVI in FIG. 24.

The embodiment according to the FIGS. 24–26 is essentially identical to the embodiment of the FIGS. 1–3, and consequently corresponding parts have therefore been given the same reference numerals as in FIG. 1 (with double accent marks in FIGS. 24–26). In said FIGS. 24–26, however, the position of a credit-card 29 in the relevant frame is clearly illustrated again.

Figure 27:
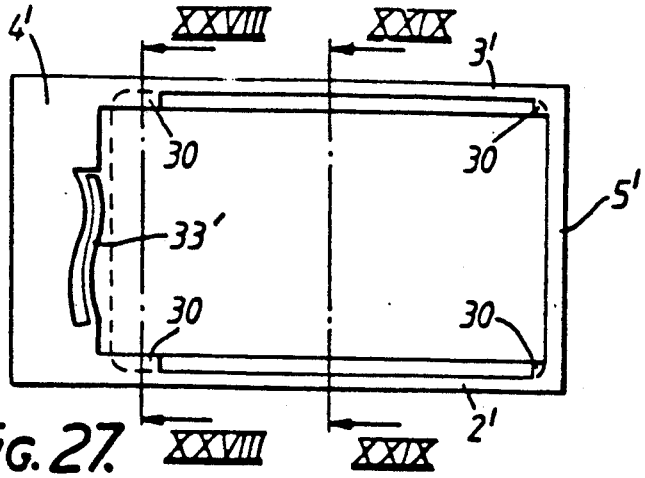
FIG. 27 shows a fourth embodiment of a card holder according to the invention.
Figure 28:
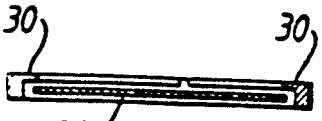
FIG. 28 is a section of FIG. 27, along the line XXVIII—XXVIII.
Figure 29:
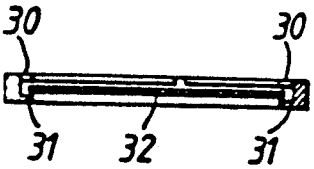
FIG. 29 is a section of FIG. 27, along the line XXIX—XXIX.

The FIGS. 27–29 show an embodiment, wherein short projecting parts or noses 30 are provided near the ends of the long sides or legs 2' and 3', respectively, said projecting parts or noses 30 joining the upper sides of said legs 2' and 3', seen in the FIGS. 28 and 29, whilst inwardly projecting parts or ribs 31 join the central parts and the lower sides of said legs 2' and 3'. As is illustrated in the FIGS. 28 and 29 a credit-card 32 can be moved between said noses 30 and ribs 31.

In the wide short side 4' there is furthermore recessed a tongue 33' having a wavy extension, said tongue being integral with said side, such that said tongue is only connected with the short side 4' in question at one end. With a correct selection of the material said tongue will have a certain resilience, so that said tongue, butting against one end of an inserted card 32, will press said card 32 against the opposite short side 5'. Also in this manner it is ensured that the card 32 is safely held in the frame, whilst it is still easy to remove the card 32 from the frame and put it back again.

Figure 30:
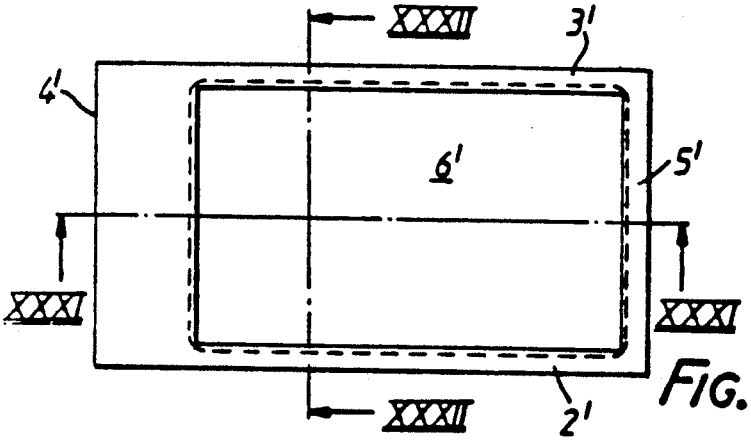
FIG. 30 shows a sixth embodiment of a card holder according to the invention.
Figure 31:
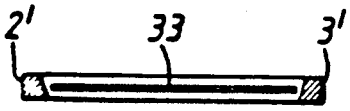
FIG. 31 is a section of FIG. 30, along the line XXXI—XXXI.
Figure 32:
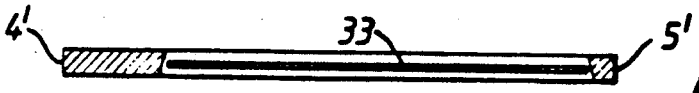
FIG. 32 is a section of FIG. 30, along the line XXXII—XXXII.

A further possibility is, as is illustrated in the FIGS. 30–32, to construct the frame such that the facing sides of the long sides 2' and 3' of the frame bounding the opening 6' slope upwards in a direction remote from each other, whilst the sides of the short sides 4' and 5' bounding the opening 6' slope upwards in a direction towards each other, whereby said sloping parts form projecting parts for enclosing a card.

It will be apparent, in particular from the FIGS. 31 and 32, that also with such a construction a good enclosure of a credit-card 33 can be realised, whilst the credit-card can still be put in and out of the frame by slightly bending the material of the credit-card and/or by slightly deforming the parts of the frame bounding the opening 6'.

Figure 33:
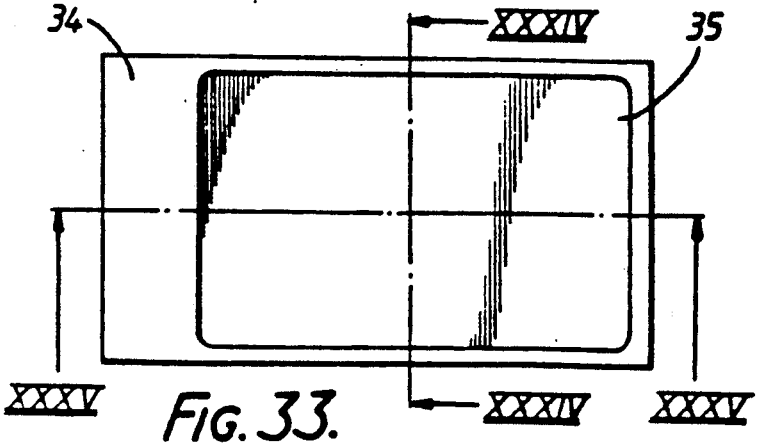
FIG. 33 shows a sixth embodiment of a lid or card holder according to the invention.
Figure 34:
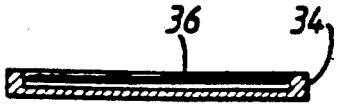
FIG. 34 is a section of FIG. 33, along the line XXXIV—XXXIV in FIG. 33.
Figure 35:
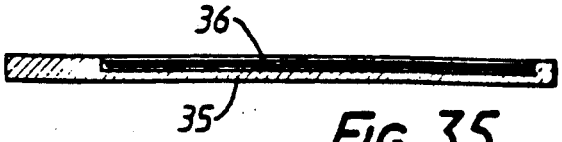
FIG. 35 is a section of FIG. 33, along the line XXXV—XXXV in FIG. 33.

In the embodiment illustrated in the FIGS. 33–35 a lid or card holder is formed by a plate-shaped means 34, in one side of which there is provided a recess 35, being closed at its bottom side, for accommodating a card 36 or another object. In this embodiment the holder 34 will be made of a slightly resilient material and the dimensions of the recess 35 will be selected such that a card 36 or the like can be pressed into the recess 35 by slightly deforming said material, so that the card 36 or the like will be held in the recess 35 as a result of frictional forces.

The card holders according to the invention are also suitable for use in a stationarily used device provided with a base with an upwardly extending pin secured thereto, on which a desired number of lids and card holders can be moved.

Possibly the base can serve as a bottom lid.

Another possibility is to place an assembly of a plurality of card holders and lids, threaded on a long pin, on a supporting surface, e.g. a desk or the like, in such a manner that the pin extends horizontally. With a correct rounding of the corner points of the card holders located near the supporting surface said card holders can be pivoted about the pin, whilst the assembly will remain supported on the supporting surface.

I claim:

1. Device for keeping credit cards comprising at least one card holder in which a credit card can be held at at least some of its edges in said at least one holder, at least one generally planar lid extending over a side of said at least one card holder, said at least one card holder being rotatably connected by a pivot pin with respect to said at least one lid and movable fan-wise in a plane parallel to said at least one lid, said at least one card holder further comprising four side legs bounding a rectangular through opening the size of a credit card to be accommodated, said side legs forming a closed frame with external dimensions at least substantially equal to the external dimensions of said at least one lid, wherein the side legs include means on facing surfaces thereof for engaging a credit card inserted into the opening and for removably holding said credit card within said closed frame and wherein one of said side legs and said at least one lid includes a through bore aligned with each other for reception of said pivot pin.

2. Device according to claim 1, wherein said means comprises a rib extending along substantially the entire length of an adjacent one side of the frame.

3. Device according to claim 2, wherein at least one opposed pair of said four side legs includes a rib.

4. Device according to claim 2 wherein a rib extending from one side leg is narrower than a rib extending from an opposite side leg.

5. Device according to claim 1 wherein said means comprises interior side edges of two opposed side legs facing the opening having a slope upward in a direction remote from each other, whilst the interior side edges of the two other side legs bounding the opening, slope upwards in a direction towards each other.

6. Device according to claim 1 wherein the frame includes a resilient means for butting against a side of the card to be accommodated, in order to press the card in the direction of an opposite edge of the frame.

7. Device according to claim 1 wherein the at least one lid and at least one card holder is pivotally connected by a pivot pin extending perpendicularly to the plane of the at least one card holder.

8. Device according to claim 1 wherein said means comprises a flat plate of a slightly resilient material, said plate including a recess the size of said credit card or the like, such that a credit card can be pressed into the recess and be held there as a result of the spring force of the material.

9. Device according to claim 1 wherein said side legs have a thickness of from about 1.4 to about 1.6 mm and wherein said means comprises at least one rib extending along opposed side legs, said at least one rib having a thickness of from about 0.3 to about 0.55 mm.

10. Device according to claim 1 including a pair of lids and a stack of card holders between said lids, and a pivot pin holding said lids and card holders together, any one of said card holders being pivotable in a fan-shaped movement relative to said lids and other card holders for selection and removal of a selected card from a selected card holder.

* * * * *

UNITED STATES PATENT AND TRADEMARK OFFICE

CERTIFICATE OF CORRECTION

PATENT NO. : 5,038,926
DATED : August 13, 1991
INVENTOR(S) : Aart van der Toorn

Figure 7:
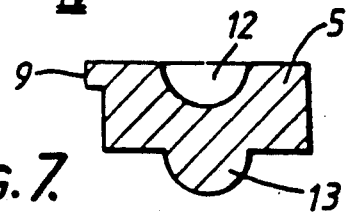
FIG. 7 is a section of FIG. 6, along the line VII—VII in FIG. 6.

It is certified that error appears in the above-identified patent and that said Letters Patent is hereby corrected as shown below:

Col. 4, line 31, delete "from FIG. 7. The" and insert --from FIG. 7, the--.

Col. 6, lines 11 and 12, delete "and FIGS. 36-37 and the".

Signed and Sealed this

Thirteenth Day of July, 1993

*Attest:*

Michael K. Kirk

MICHAEL K. KIRK

*Attesting Officer*

*Acting Commissioner of Patents and Trademarks*